US005664303A

United States Patent [19]

Johnson

[11] Patent Number: 5,664,303

[45] Date of Patent: Sep. 9, 1997

[54] DIFFERENTIAL FLANGE HEADER PACKAGE

[75] Inventor: Joel L. Johnson, Buffalo Grove, Ill.

[73] Assignee: Illinois Tool Works Inc., Glenview, Ill.

[21] Appl. No.: 554,278

[22] Filed: Nov. 6, 1995

[51] Int. Cl.[6] ..... B65D 33/24

[52] U.S. Cl. ..... 24/587; 24/30.5 R

[58] Field of Search ..... 206/806; 383/63, 383/65, 68, 200, 210, 211, 61; 24/587, 576, 30.5 R

[56] References Cited

U.S. PATENT DOCUMENTS

| | | | |
|---|---|---|---|
| 3,780,781 | 12/1973 | Uramoto | 383/65 X |
| 4,589,145 | 5/1986 | Van Erden et al. | 383/65 X |
| 4,630,311 | 12/1986 | Bentson | 383/63 X |
| 4,846,585 | 7/1989 | Boeckmann et al. | 383/63 X |
| 5,242,516 | 9/1993 | Custer et al. | 24/587 X |
| 5,369,847 | 12/1994 | Naya et al. | 383/65 X |
| 5,419,437 | 5/1995 | Huseman | 383/63 X |
| 5,513,915 | 5/1996 | May | 383/61 X |

*Primary Examiner*—James R. Brittain

*Attorney, Agent, or Firm*—Kane, Dalsimer, Sullivan, Kurucz, Levy, Eisele and Richard, LLP

[57] ABSTRACT

A zipper for a reclosable package includes a male interlocking profile and a female interlocking profile having male and female interlocking members, respectively. One, and only one, of the male and female interlocking profiles includes an extended flange separated and separable therefrom by perforations. In a reclosable package, polymeric sheet material is bonded to the male and female interlocking profiles and, specifically, to both sides of the extended flange. The extended flange, so reinforced with polymeric sheet material, can thereafter be used as a header from which the package may be hung for display in a retail store. Because of the perforations separating the extended flange from one of the two profiles, the header may be readily torn from the package to provide a consumer with access to its contents.

8 Claims, 3 Drawing Sheets

DIFFERENTIAL FLANGE HEADER PACKAGE

BACKGROUND OF THE INVENTION

1. Field of the Invention

The present invention relates to reclosable plastic bags of the type in which perishable food products are packaged and sold to consumers in retail outlets. More specifically, the present invention relates to a reclosable plastic bag of this type, wherein the bag has an easy-open feature and a strong region from which it may be hung for display to consumers in a retail outlet.

2. Description of the Prior Art

The prior art is replete with reclosable plastic bags of the above general type. For example, U.S. Pat. No. Re. 33,674 shows a plastic film structure for forming a bag including a sheet of thin plastic film with continuous shaped interlocking rib and groove profiles thereon either integral with the film or on strips which are fused to the film. The sheet has plastic reinforcing strips thereon between the profiles. The reinforcing strips provide tear guidelines for tearing off the top of a bag formed from the sheet and to provide gripping flanges for separating the profiles and for opening the bag.

Bags of the type shown in this patent have proven to be quite difficult to open and to seal. The present invention provides a much improved package of the tear-open type.

SUMMARY OF THE INVENTION

Accordingly, the present invention is a zipper for a reclosable package. The zipper comprises a male interlocking profile and a female interlocking profile which are to be bonded to polymeric sheet material in the production of the package. One, and only one, of the male and female interlocking profiles includes an extended flange separated and separable therefrom by perforations.

In the production of reclosable packages incorporating the zipper of the present invention, polymeric sheet material is bonded to the male and female interlocking profiles to provide the packages with reclosable openings. At the same time, the polymeric sheet material is bonded to both sides of the extended flange. This provides the package with a header from which it may be hung for display in a retail outlet. Further, because of the perforations separating the extended flange from the male or female interlocking profile, the header may be torn from the rest of the package to provide access to the contents within the package.

The present invention will now be described in more complete detail with frequent reference being made to the figures identified below.

DETAILED DESCRIPTION OF THE PREFERRED EMBODIMENT

Figure 1:
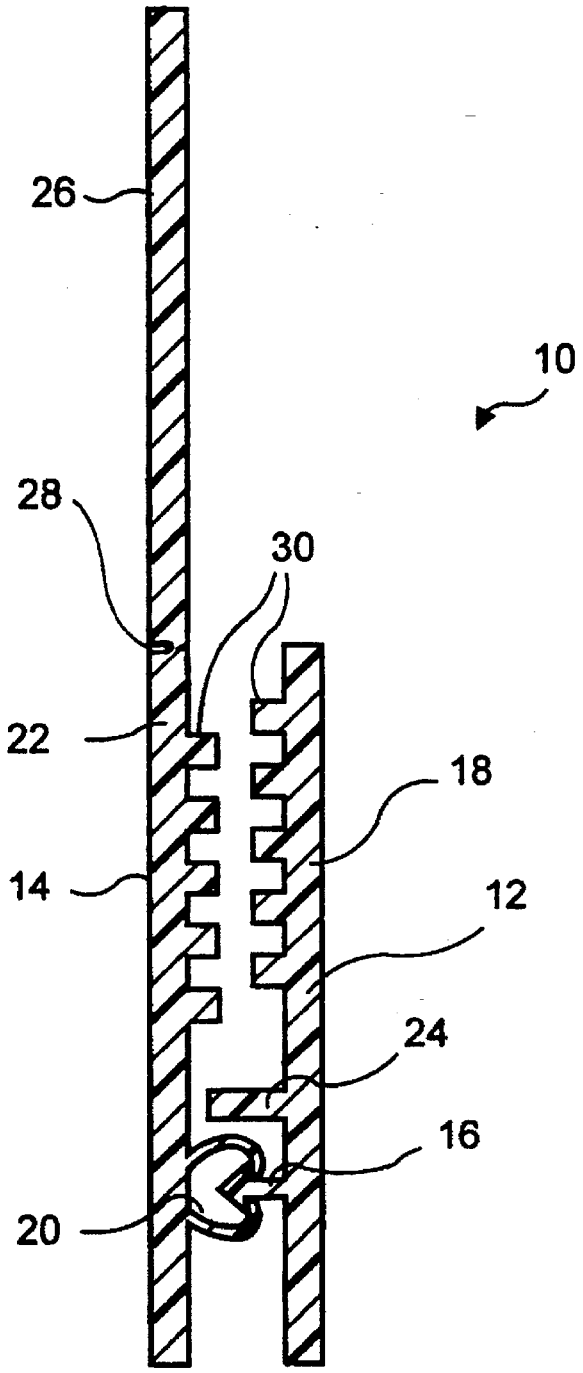
FIG. 1 is a cross-sectional view of the zipper of the present invention.

FIG. 1 is a cross-sectional view of the zipper 10 of the present invention. The zipper 10 includes a male interlocking profile 12 and a female interlocking profile 14.

The male interlocking profile 12 includes an arrowhead-shaped male interlocking member 16 and a web 18. The female interlocking profile 14 includes a female interlocking member 20 and a web 22. The female interlocking member 20 includes two portions which curve toward one another and between which the male interlocking member may be snappingly disposed to join the male interlocking profile 12 to the female interlocking profile 14.

The male interlocking profile 12 may also include a guide rib 24 adjacent to male interlocking member 16 on web 18 to facilitate the joining of the male interlocking profile 12 to the female interlocking profile 14. The guide rib 24 assists in disposing the male interlocking member 16 relative to the female interlocking member 20 so that they may readily be interlocked with one another, as the male interlocking member 16 and the guide rib 24 define a space into which the female interlocking member 20 must be guided to effect the interlocking.

Either the male interlocking profile 12 or, as shown in FIG. 1, the female interlocking profile 14 includes an extended flange 26 which, in either case, is a continuation of the web 18, 22. As shown in FIG. 1, extended flange 26 is separated from web 22 by perforations 28 at a location even with the end of web 18 of male interlocking profile 12. The perforations 28 may be 1/16-inch slits separated by 1/16-inch land areas.

The mutually facing surfaces of webs 18, 22 may be provided with a plurality of grip strips 30 to facilitate the opening of a package incorporating zipper 10 by a consumer.

Figure 2:
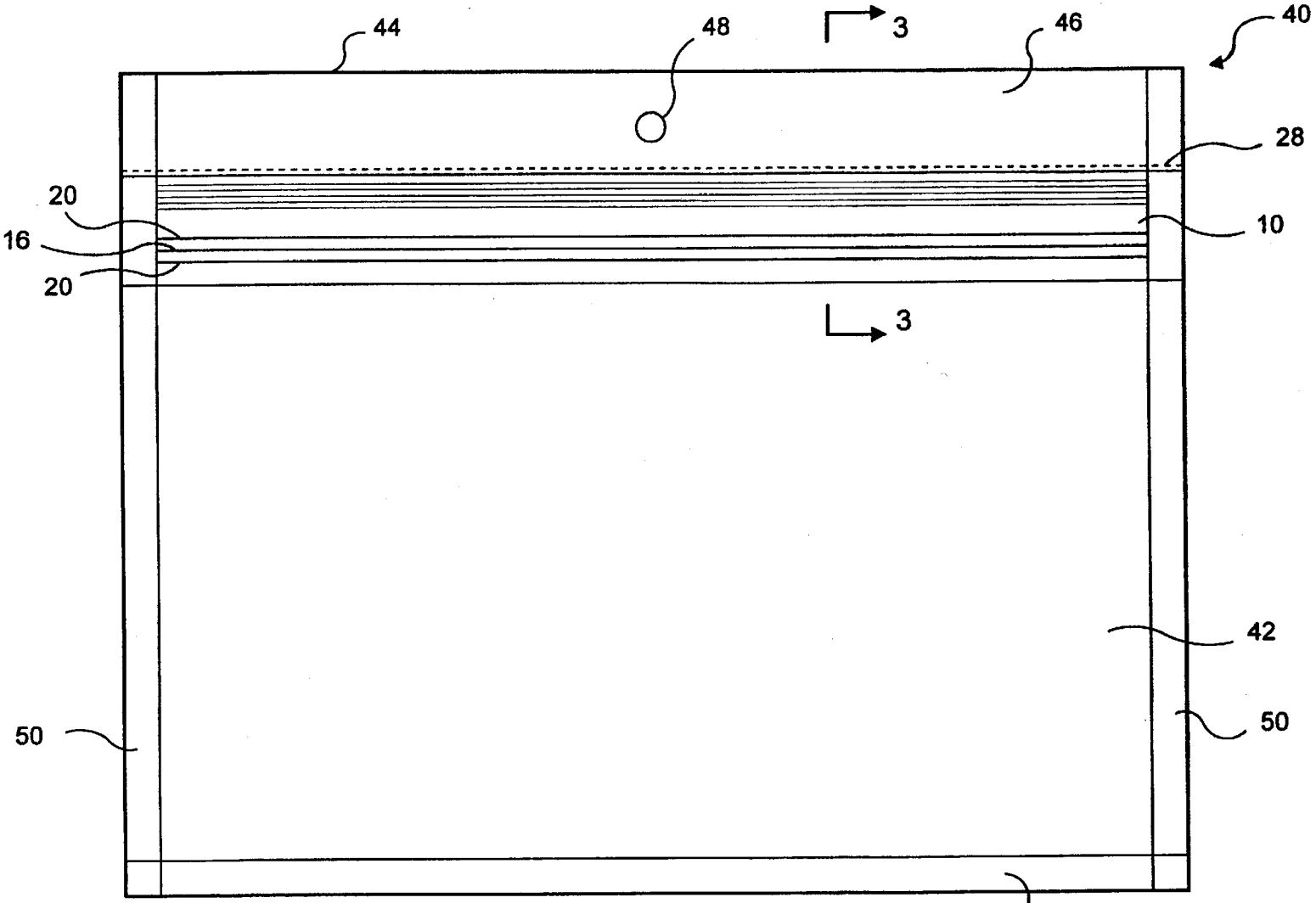
FIG. 2 is a plan view of a package incorporating the zipper.

FIG. 2 is a plan view of a package 40 which includes the zipper 10. The package 40 is primarily constructed from polymeric sheet material 42 on a horizontal form-fill-and-seal (FFS) machine, on which a plurality of packages 40 are manufactured and filled with a consumer product in a continuous process.

Polymeric sheet material 42 is bonded to both sides of zipper 10, including both sides of extended flange 26. The region above perforation 28, where polymeric sheet material 42 is bonded to both sides of extended flange 26, functions as a header 46, which may be torn from the package 40 by a consumer initially opening the package 40. The header 46 also acts as a reinforced band through which a hole 48 may be punched to permit the package 40 to be displayed on a peg in a retail store. Once the header 46 is torn away, the consumer will have access to the interior of the package 40 and to its contents, not shown in FIG. 2 for the sake of clarity, through the separation of male interlocking member 16 from female interlocking member 20.

As noted above, polymeric sheet material 42 is bonded to zipper 10 during the production of packages 40 on a horizontal FFS machine. Side seals 50 are formed to separate one package 40 from the next by cross-seal bars. Bottom seal 52 is formed to complete the package 40 immediately after a premeasured amount of a consumer product is dropped thereinto, the package being in an upside-down orientation during the forming, filling and sealing process.

Figure 3:
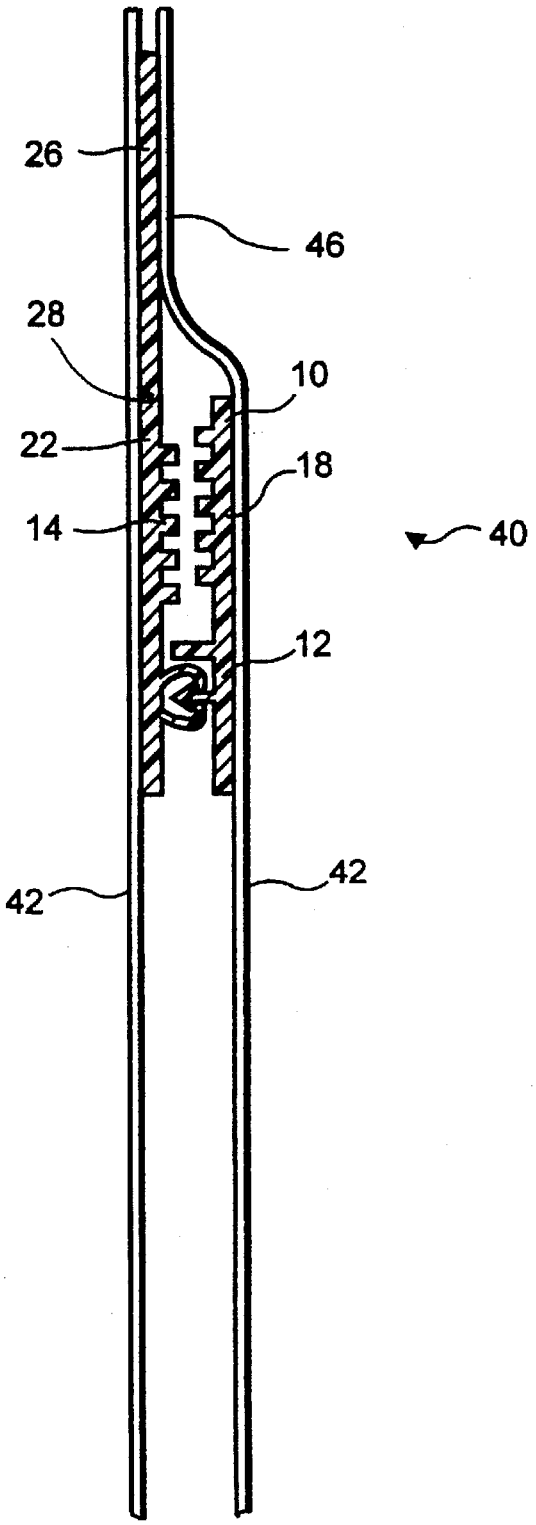
FIG. 3 is a cross-sectional view taken as indicated by line 3–3' in FIG. 2.

FIG. 3 is a cross-sectional view taken as indicated by line 3–3' in FIG. 2. Polymeric sheet material 42 is bonded to the outward facing sides of both the male interlocking profile 12 and the female interlocking profile 14, and to both sides of the extended flange 26. Extended flange 26 and the polymeric sheet material 42 bonded to both sides thereof form the header 46 described above. Header 46, accordingly, is a band of sealed area above the zipper 10, and aids in hermetically sealing the package 40, yet is sufficiently strong to support the weight of the package 40 when a hole 48 is punched therethrough for hanging it for point-of-sale display. Header 46 may be torn from package 40 by means of perforations 28, the polymeric sheet material 42 tearing therewith along the tops of webs 18, 22 to provide access to the interior of the package 40.

Polymeric sheet material 42 may be produced by extrusion and biaxial stretching from any of the polymeric resin materials used for such purposes by those of ordinary skill in the art. Polyethylene is but one polymeric resin material commonly used for such purposes. Zipper 10, in like manner, may be extruded from a polymeric resin material, such as low-density polyethylene (LDPE).

The zipper 10 of the present invention allows a food packager to dispense both zipper profiles and header material from a single spool on a FFS machine, instead of from separate spools as is commonly done in the industry.

Modifications to the present invention may be obvious to those of ordinary skill in the art, and would not bring the invention so modified beyond the scope of the appended claims.

What is claimed is:

1. A zipper for a reclosable package comprising a male interlocking profile and a female interlocking profile, said profiles each having one side to be directed toward the interior of a package wherein only one of said profiles includes an extended flange separated and separable therefrom by perforations, said extended flange being directed away from the sides of the profiles to be directed toward the interior of the package for connection to both sides of the package.

2. A zipper as claimed in claim 1 wherein said male interlocking profile includes a web and said female interlocking profile includes a web, and wherein said extended flange is a continuation of said web on one of said male and female interlocking profiles separable therefrom by said perforations.

3. A zipper as claimed in claim 2 wherein said perforations align with an edge of said web not having said extended flange when said male and female interlocking profiles are joined to one another.

4. A zipper as claimed in claim 2 wherein said webs of said male and female interlocking profiles have surfaces which face one another when said profiles are joined to one another, said surfaces each having a plurality of grip strips thereon.

5. A zipper as claimed in claim 1 wherein said male interlocking profile includes a male interlocking member and said female interlocking profile includes a female interlocking member, said male interlocking member being snappingly securable within said female interlocking member to join said male and female interlocking profiles to one another.

6. A zipper as claimed in claim 5 wherein said male interlocking member has an arrowhead-shaped cross section, and said female interlocking member has two portions which curve toward one another to form a space into which said male interlocking member may be snappingly secured.

7. A zipper as claimed in claim 1 wherein said male and female interlocking profiles are extruded from a polymeric resin material.

8. A zipper as claimed in claim 7 wherein said polymeric resin material is low-density polyethylene (LDPE).

* * * * *